US007717799B2

(12) United States Patent
Habing

(10) Patent No.: US 7,717,799 B2
(45) Date of Patent: May 18, 2010

(54) GLIDER TEETER-TOTTER

(75) Inventor: Theodore G. Habing, Tustin, CA (US)

(73) Assignee: Dream Visions, LLC, Tustin, CA (US)

( * ) Notice: Subject to any disclaimer, the term of this patent is extended or adjusted under 35 U.S.C. 154(b) by 170 days.

(21) Appl. No.: 12/016,942

(22) Filed: Jan. 18, 2008

(65) Prior Publication Data

US 2009/0186711 A1 Jul. 23, 2009

(51) Int. Cl.
*A63G 11/00* (2006.01)
*A63G 9/16* (2006.01)

(52) U.S. Cl. ..... 472/108; 472/120

(58) Field of Classification Search ..... 472/106, 472/108, 109, 111, 112, 135, 120–121; 482/72, 482/73, 130
See application file for complete search history.

(56) References Cited

U.S. PATENT DOCUMENTS

| | | | | |
|---|---|---|---|---|
| 124,262 | A | | 3/1872 | Fowler |
| 654,779 | A | | 7/1900 | Bowland |
| 1,420,787 | A | | 6/1922 | Thomas |
| 1,429,289 | A | | 9/1922 | Maxwell et al. |
| 1,437,888 | A | | 12/1922 | Davis |
| 1,543,619 | A | | 6/1925 | Pryor |
| 1,553,418 | A | | 9/1925 | Watts |
| 1,659,735 | A | | 2/1928 | Jamison |
| 1,714,247 | A | | 5/1929 | Smedley |
| 1,746,260 | A | | 2/1930 | Kenney |
| 1,866,906 | A | | 7/1932 | Rager |
| 1,952,548 | A | | 3/1934 | Hayes |
| 2,092,993 | A | | 9/1937 | Tinker |
| 2,222,119 | A | | 11/1940 | Overholt |
| 2,247,533 | A | | 7/1941 | Cicero |
| 2,471,572 | A | | 5/1949 | Loker |
| 2,488,889 | A | * | 11/1949 | Allie ..... 472/112 |
| 2,545,295 | A | | 3/1951 | Miller |
| 2,616,485 | A | | 11/1952 | Robbins |
| 2,648,538 | A | | 8/1953 | Robbins |
| 2,685,915 | A | | 8/1954 | Hannas |
| 2,699,201 | A | * | 1/1955 | Levy ..... 472/120 |
| 2,701,604 | A | | 2/1955 | St. Louis |
| 2,738,831 | A | | 3/1956 | Sage |
| 2,812,011 | A | * | 11/1957 | Jansson ..... 472/120 |
| 3,051,481 | A | | 8/1962 | Johnson |
| 3,311,373 | A | | 3/1967 | Phillips |
| 3,447,802 | A | * | 6/1969 | Grudoski ..... 472/120 |
| 4,190,248 | A | * | 2/1980 | Philippi ..... 472/120 |
| 4,226,411 | A | | 10/1980 | Manus |
| 4,570,928 | A | | 2/1986 | Smith |
| 4,944,507 | A | | 7/1990 | Efstratis |

* cited by examiner

*Primary Examiner*—Kien T Nguyen
(74) *Attorney, Agent, or Firm*—Blakely, Sokoloff, Taylor & Zafman LLP

(57) ABSTRACT

An improved teeter-totter has a pair of seats mounted at opposite ends of a longitudinal seat support member. The seat support member is suspended from overhead pivots by a pair of linkage arms to provide riders with a motion that combines the up-and-down arcuate motion of a conventional teeter-totter with a back-and-forth gliding motion, thus creating a more stable and balancing effect allowing users of different weights, to use the teeter-totter without other counter balance features.

16 Claims, 2 Drawing Sheets

GLIDER TEETER-TOTTER

BACKGROUND OF THE INVENTION

1. Field of the Invention

This invention relates generally to the field of playground equipment and, more particularly, to an improved teeter-totter or seesaw.

2. Background

Teeter-totters (also referred to as seesaws) have been popular with children since before recorded history. In its simplest form, a teeter-totter may be constructed by merely placing a board over an object to serve as a fulcrum or pivot. Modern day playground teeter-totters are essentially the same, although the structural members are more typically steel for improved durability. Thus, a typical playground teeter-totter comprises a beam supported off the ground by a horizontal support member. The beam is coupled to the support member with a simple pivot assembly and has a seat mounted at each end thereof. Children in the seats experience generally up-and-down arcuate motion when playing on a teeter-totter.

On a typical teeter-totter, people of different weights have a harder time using the teeter-totter because the teeter-totter acts like a balance, thus causing the heavier person to settle in the lower position wherein they must push off the ground harder to create motion and get the other person down. The heavier person must use leg muscles to push and balance thus straining the legs and taking some of the enjoyment out of the playfulness of a teeter-totter. Some prior art teeter totters have a counter balance spring or weight to counter act the weight of the heavier person.

Gliders, both free-standing and suspended, are also widely popular. Their popularity is largely due to the relaxing back-and-forth motion of the glider. Gliders are not affected by different weights of users because the pivotal support is more stable and balancing. Heretofore, no known apparatus has successfully combined the up-and-down accurate motion of a conventional teeter-totter with the back-and-forth motion of a glider creating a more stable teeter totter that is not as sensitive to users of different weights.

SUMMARY OF THE INVENTION

The present invention provides an improved teeter-totter with a pair of seats mounted at opposite ends of a longitudinal seat support member. The seat support member is suspended from overhead pivots by a pair of linkage arms to provide riders with a more stable and balancing motion that combines the up-and-down arcuate motion of a conventional teeter-totter with a back-and-forth gliding motion. This motion reduces the bump at the bottom of a teeter totter seat on the ground by including horizontal motion. The bump may be completely eliminated by increasing the horizontal motion at the bottom. The pivotal support of this teeter-totter is more stable and balancing allowing users of different weights, to use the teeter-totter without other counter balance features.

DETAILED DESCRIPTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
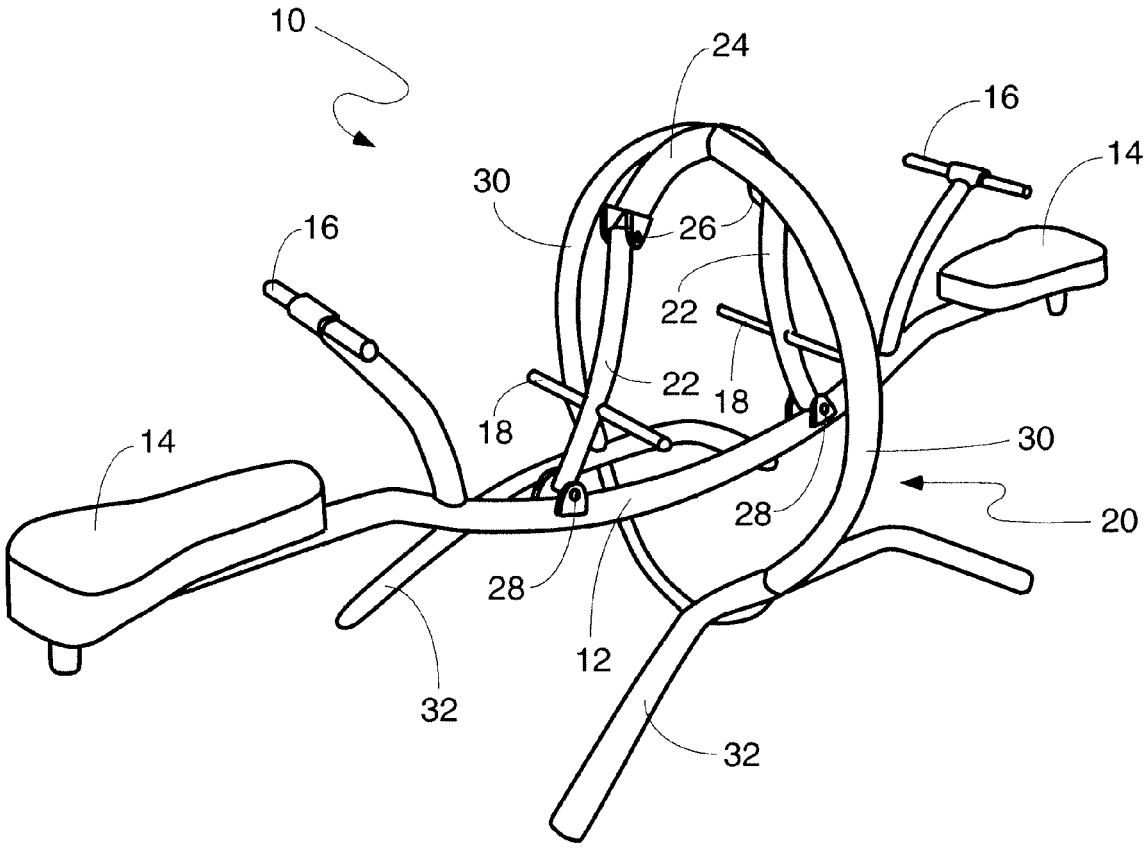
FIG. 1 is a perspective view of one embodiment of a teeter-totter in accordance with the present invention.

FIG. 1 is a perspective view of one embodiment of a teeter-totter 10 in accordance with the present invention. A longitudinal seat support member 12 supports a pair of seats 14 at respective ends thereof. Handlebars 16 are provided to assist users in maintaining their balance while operating the teeter-totter. The seat support member is suspended from support frame 20 by a pair of linkage arms 22. The linkage arms are independently pivotally connected to longitudinal pivot support member 24 at pivot points 26. Linkage arms 22 are also independently pivotally connected to the seat support member at pivot points 28. Foot supports 18 are attached to the linkage arms for use at each of seats 14.

Support frame 20 is composed of leg members 30 and respective base members 32. The design of teeter-totter 10 with seat support member 12 suspended between the transversely-located leg members 30 eliminates pinch points that are common with conventional teeter-totter design. The spaced apart base members also provide a more stable support for the teeter-totter. As shown, leg members 30 are curved concave to the seat support member 12 forming a hoop-like structure. However, the leg members could have different shapes, bearing in mind that it is desirable to have the leg members spaced apart on either side of the seat support member so as to eliminate pinch points The structural components of teeter-totter 10 may be formed of steel tubing as is conventional in the field of fitness and exercise equipment and may be protected with a powder-coated finish. Seats 14 may be of a molded plastic for durability and weather resistance. Other suitable materials may be used and the invention is not limited in this regard.

Teeter-totter 10 is used in a conventional manner, with a rider on each of seats 14. The motion experienced by riders of the teeter-totter, however, is substantially different from conventional teeter-totters. Suspension of the seat support member 12 by linkage arms 22 imparts a glider-like motion in combination with the up-and-down arcuate motion of conventional teeter-totters. In a conventional teeter-totter, the seats move in simple circular arcs about the pivot point. However, because of the multiple pivot points in the present invention, the seats have paths of motion that are not circular arcs. Riders of the teeter-totter may propel themselves in the same manner as with conventional teeter-totters, i.e., by pushing with their legs against the ground, by a pumping motion with their bodies or a combination of the two. In addition, riders may propel themselves by pressing their feet against foot support 18.

Figure 2:
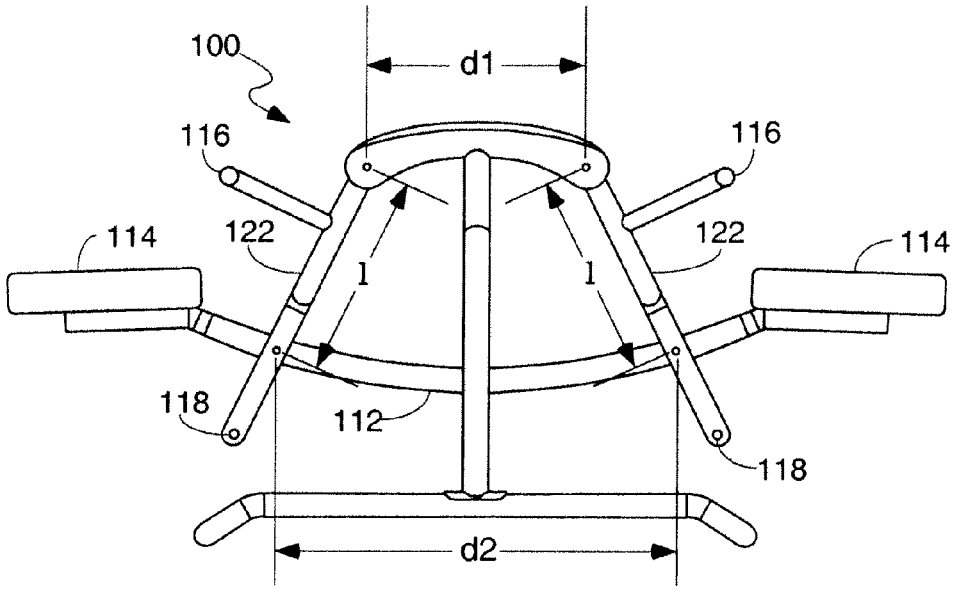
FIG. 2 is a side elevation view of another embodiment of a teeter-totter in accordance with the present invention.

FIG. 2 is a side elevation view of another embodiment of a teeter-totter 100 in accordance with the present invention. This teeter-totter is similar in overall design and construction to teeter-totter 10 described above. In the case of teeter-totter 100, handlebars 116 are attached to linkage arms 122 rather than seat support member 112. Attaching the handlebars in this manner allows the riders to propel themselves by pushing and pulling on the handlebars. In this embodiment, foot supports 118 are located below seats 114 on extended linkage arms 122. As with the previously described embodiment, the foot supports can also be used by the riders to propel themselves FIG. 2 also shows a pair of pivots longitudinally spaced apart by a distance d1, the seat support member 112 is pivotally suspended from the pivots at locations spaced apart by a distance d2 by a pair of linkage arms 122 having a length l; wherein d1<d2 and l<d2.

Figure 3:
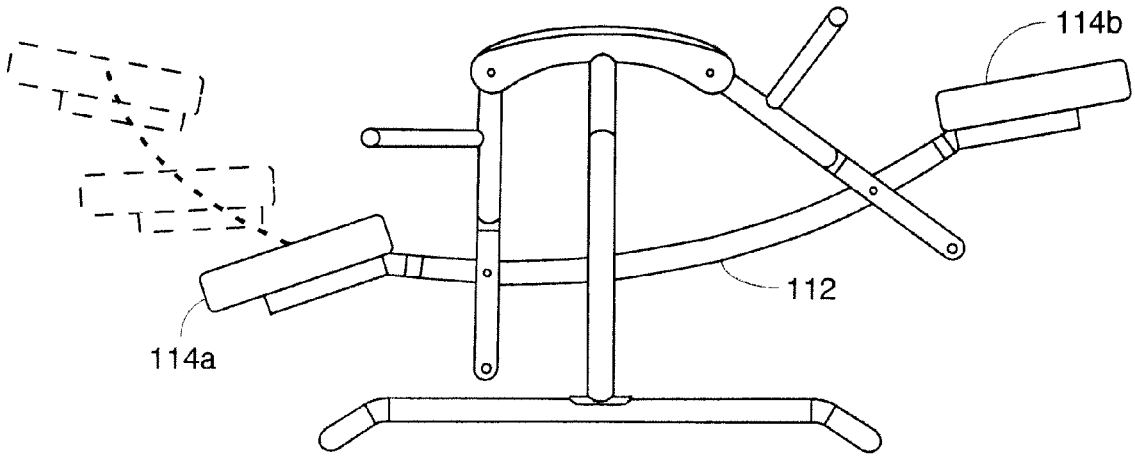
FIG. 3 is another side elevation view of the teeter-totter shown in FIG. 2 illustrating the path of motion of one of the seats.

FIG. 3 shows teeter-totter 100 with seat support member 112 approaching a limit of travel to the right. Left-hand seat 114*a* is near its lower limit of travel, while right-hand seat 114*b* is near its upper limit of travel. As indicated in broken lines near left-hand seat 114*a*, the seat has a non-circular arcuate path of travel with components of both up-and-down and back-and-forth motion.

It will be recognized that the above-described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. A teeter-totter comprising:

a pair of longitudinally spaced apart seats;

a longitudinal seat support member having one of the pair of seats disposed at each end thereof;

a support frame having a pair of pivots longitudinally spaced apart by a distance d1, the longitudinal seat support member being pivotally suspended from the pivots at locations longitudinally spaced apart by a distance d2 by a pair of linkage arms having a length l;

wherein d1<d2 and l<d2.

2. The teeter-totter of claim 1 further comprising a handlebar disposed at each of the seats.

3. The teeter-totter of claim 2 wherein the handlebars are attached to the seat support member.

4. The teeter-totter of claim 2 wherein the handlebars are attached to respective ones of the linkage arms.

5. The teeter-totter of claim 1 further comprising a foot support disposed at each of the seats.

6. The teeter-totter of claim 5 wherein the foot support comprises a transverse bar suspended below and forward of the respective seat.

7. The teeter-totter of claim 5 wherein the foot support comprises a transverse bar attached to a respective one of the linkage arms.

8. The teeter-totter of claim 1 wherein the support frame comprises a pair of leg members extending downwardly from the pivots and oriented transversely on opposite sides of the seat support member.

9. The teeter-totter of claim 8 wherein the leg members are curved concave to the seat support member.

10. A teeter-totter comprising:

a pair of longitudinally spaced apart seats attached at respective ends of a longitudinal seat support member;

a support frame having a longitudinal pivot support member disposed above the seat support member;

a pair of linkage arms having a length l pivotally coupled at first ends thereof to respective ends of the pivot support member longitudinally spaced apart by a distance d1 and pivotally coupled at second ends thereof to the seat support member at locations longitudinally spaced apart by a distance d2;

wherein d1<d2 and l<d2.

11. The teeter-totter of claim 10 further comprising a handlebar disposed at each of the seats.

12. The teeter-totter of claim 11 wherein the handlebars are attached to the seat support member.

13. The teeter-totter of claim 10 further comprising a foot support disposed at each of the seats.

14. The teeter-totter of claim 13 wherein the foot supports are attached to respective ones of the linkage arms.

15. The teeter-toiler of claim 10 wherein the support frame comprises a pair of leg members extending downwardly from the pivot support member and oriented transversely on opposite sides of the seat support member.

16. The teeter-toiler of claim 15 wherein the leg members are curved concave to the seat support member.

* * * * *

UNITED STATES PATENT AND TRADEMARK OFFICE

CERTIFICATE OF CORRECTION

PATENT NO. : 7,717,799 B2
APPLICATION NO. : 12/016942
DATED : May 18, 2010
INVENTOR(S) : Habing It is certified that error appears in the above-identified patent and that said Letters Patent is hereby corrected as shown below:

Column 4,

Claim 15, line 1, delete “teeter-toiler”, insert -- teeter-totter --
Claim 16, line 1, delete “teeter-toiler”, insert -- teeter-totter --

Signed and Sealed this
Nineteenth Day of April, 2011

David J. Kappos

David J. Kappos
*Director of the United States Patent and Trademark Office*